US009281584B2

(12) United States Patent
Hashiguchi

(10) Patent No.: US 9,281,584 B2
(45) Date of Patent: Mar. 8, 2016

(54) CONNECTOR

(71) Applicant: JAPAN AVIATION ELECTRONICS INDUSTRY, LIMITED, Shibuyaku, Tokyo (JP)

(72) Inventor: Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/487,934

(22) Filed: Sep. 16, 2014

(65) Prior Publication Data

US 2015/0099376 A1 Apr. 9, 2015

(30) Foreign Application Priority Data

Oct. 7, 2013 (JP) ..... 2013-210502

(51) Int. Cl.
*H01R 12/00* (2006.01)
*H01R 12/71* (2011.01)
*H01R 13/24* (2006.01)

(52) U.S. Cl.
CPC ..... *H01R 12/714* (2013.01); *H01R 13/2428* (2013.01); *H01R 13/2435* (2013.01); *H01R 13/2478* (2013.01)

(58) Field of Classification Search
CPC ..... H01R 9/096; H01R 12/57; H01R 12/714; H01R 13/2428; H01R 23/722; H05K 7/1069
USPC ..... 439/66, 65, 91, 862
See application file for complete search history.

(56) References Cited

U.S. PATENT DOCUMENTS 5,664,973 A * 9/1997 Emmert et al. ..... 439/862
5,967,856 A * 10/1999 Meller ..... 439/700
5,980,335 A * 11/1999 Barbieri et al. ..... 439/824
6,976,851 B2 * 12/2005 Huang ..... 439/66
7,226,293 B2 * 6/2007 Na et al. ..... 439/66
7,819,705 B2 * 10/2010 Akama ..... 439/66

FOREIGN PATENT DOCUMENTS

JP 2002313460 A 10/2002

* cited by examiner

*Primary Examiner* — Neil Abrams
*Assistant Examiner* — Travis Chambers
(74) *Attorney, Agent, or Firm* — Holtz, Holtz & Volek PC

(57) ABSTRACT

A connector reduced in height without reducing contact reliability. A contact of the connector includes a first spring portion that supports a contact portion, a second spring portion that supports a connection portion, and an integral connection portion that integrally connects the first spring portion and the second spring portion. The first spring portion and the second spring portion are arranged on an imaginary straight line that extends through the contact portion and is parallel to a connection direction, and the integral connection portion is made away from the imaginary straight line in a direction orthogonal to the connection direction.

20 Claims, 15 Drawing Sheets

CONNECTOR

BACKGROUND OF THE INVENTION

1. Field of the Invention

This invention relates to a connector.

2. Description of the Related Art

Conventionally, there has been proposed a connector that is arranged between two printed circuit boards 961 and 962 (see FIG. 15), and electrically connects the two printed circuit boards 961 and 962 (see Japanese Laid-Open Patent Publication (Kokai) No. 2002-313460). This connector will be described with reference FIGS. 13 to 15.

The connector comprises an insulator 950 and a plurality of contacts 901 each having a spring structure, which are held by the insulator 950.

The insulator 950 is formed with a plurality of contact accommodation spaces 952 for movably accommodating the contacts 901, respectively. The contact accommodation spaces 952 extend through the insulator 950 in a direction D of connecting the printed circuit boards 961 and 962 (direction of connecting objects to be connected). The insulator 950 is formed with a contact restricting portion 953 extending through each contact accommodation space 952. The contact restricting portion 953 is a portion for restricting the amount of movement of the contact 901.

Each contact 901 is formed by molding a metal plate into a substantially W-shape by press processing. More specifically, opposite ends of the contact 901 are each bent into an arcuate shape to thereby form contact portions 902 and 903 which can be brought into contact with connection pads (not shown) of the printed circuit boards 961 and 962, respectively. An intermediate portion of the contact 901 is bent to form a holding portion 904 that can surround substantially the whole periphery of the contact restricting portion 953. Spring portions 910 and 911 which are elastically deformable in the connection direction D are located between the holding portion 904 and the two contact portions 902 and 903, respectively. Portions integrally connecting the holding portion 904 and the spring portions 910 and 911, respectively, are each bent back into an arcuate shape to form two bent-back portions (curving portion) 910A and 911A. A dimension of a gap 912 between the bent-back portions 910A and 911A in the connection direction D is smaller than a dimension L of the contact restricting portion 953 in the connection direction D. The two contact portions 902 and 903 protrude out of the contact accommodation space 952 of the insulator 950, respectively.

A description will be given of how to use the connector with reference to FIGS. 14 and 15. The connector is used in a state press-fitted in a press-fitting hole 921 of a frame 920 in advance. The press-fitting hole 921 is larger in length in the connection direction D than each contact accommodation space 952. The contact portions 902 and 903 of each contact 901 protrude out of the press-fitting hole 921 in a state in which the connector has been press-fitted in the press-fitting hole 921 of the frame 920.

First, positioning of the connector is performed such that the contact portions 903 of the contacts 901 are positioned on the contact pads of the lower printed circuit board 962, respectively. Next, in this state, the connector is moved down along the connection direction D. After the connector is thus arranged in a predetermined position on the lower printed circuit board 962, positioning of the upper printed circuit board 961 is performed such that the contact pads of the upper printed circuit board 961 are positioned on the contact portions 902 of the contacts 901, respectively. Finally, in this state, the upper printed circuit board 961 is moved down along the connection direction D. At this time, both the spring portions 910 and 911 of the contacts 901 are almost equally bent, and both the contact portions 902 and 903 of the contacts 901 are pressed against the contact pads of the printed circuit boards 961 and 962, respectively, by almost equal contact forces caused by elastic forces of the spring portions 910 and 911, whereby the contact pads of the printed circuit boards 961 and 962 are electrically connected via the contacts 901.

As shown in FIG. 13, the holding portion 904 is located on an imaginary straight line S (straight line parallel to the connection direction D) connecting the pair of contact portions 902 and 903. Since this structure is employed, to connect the printed circuit boards 961 and 962 using the connector, enough spaces for both the spring portions 910 and 911 of the contact 901 to be bent (space for preventing displacement of the contact portions 902 and 903 from being restricted by the holding portion 904 when the printed circuit boards 961 and 962 are connected using the connector) are required to be provided between the contact portions 902 and 903, and the opposite ends of the holding portion 904 (opposite ends in the connection direction D), respectively. To ensure the spaces, the connector is press-fitted in the press-fitting hole 921 of the frame 920.

Unless the frame 920 is used, to ensure a predetermined contact force, it is required to make the length of the contact accommodation space 952 in the connection direction D equal to the length of the press-fitting hole 921 in the connection direction D, which results in an increase in the size of the connector.

SUMMARY OF THE INVENTION

The present invention has been made in view of these circumstances, and an object thereof is to reduce the height of a connector without reducing contact reliability.

To attain the above object, in a first aspect of the present invention, there is provided a connector that includes a housing having contact accommodation spaces, and contacts accommodated in the contact accommodation spaces, respectively, and electrically connects a first object to be connected and a second object to be connected, each contact having a contact portion that is brought into contact with the first object to be connected, a connection portion that is brought into contact with the second object to be connected, and an elastic deformation portion that integrally connects the contact portion and the connection portion, the elastic deformation portion comprising a first spring portion that is integrally connected to the contact portion, a second spring portion that is integrally connected to the connection portion, and an integral connection portion that integrally connects the first spring portion and the second spring portion, wherein, assuming that a direction in which, when connecting the first object to be connected and the second object to be connected, the contact portion is urged by the first object to be connected and is brought into contact with the first object to be connected, is defined as a connection direction, the first spring portion including a first supporting arm portion that supports the contact portion, and extends from the contact portion in an intersecting direction intersecting with the connection direction, a first bent portion that is arc-shaped and is integrally connected to the first supporting arm portion, and a first intermediate arm portion that is integrally connected to the first bent portion, and extends in a direction opposite to the first supporting arm portion, wherein the first spring portion and the second spring portion are arranged on an imaginary straight line parallel to the connection direction, the imaginary straight line extending through the contact portion, and wherein the integral connection portion is displaced from the imaginary straight line in an orthogonal direction which is orthogonal to the connection direction.

Preferably, when connecting the first object to be connected and the second object to be connected, the integral connection portion is movable in the connection direction.

Preferably, the second spring portion includes a second supporting arm portion that supports the connection portion, and extends from the connection portion in the intersecting direction, a second bent portion that is arc-shaped and is integrally connected to the second supporting arm portion, and a second intermediate arm portion that is integrally connected to the second bent portion, and extends in a direction opposite to the second supporting arm portion, wherein the integral connection portion includes a third bent portion that is arc-shaped and is integrally connected to the first intermediate arm portion, a first integral connection portion-side arm portion that is integrally connected to the third bent portion, and extends along the connection direction, a fourth bent portion that is arc-shaped and is integrally connected to the first integral connection portion-side arm portion, a fifth bent portion that is arc-shaped and is integrally connected to the second intermediate arm portion, a second integral connection portion-side arm portion that is integrally connected to the fifth bent portion, and extends in a direction opposite to the first integral connection portion-side arm portion, a sixth bent portion that is arc-shaped and is integrally connected to the second integral connection portion-side arm portion, and a straight arm portion that integrally connects the fourth bent portion and the sixth bent portion, and wherein the first bent portion, the second bent portion, the fourth bent portion, and the sixth bent portion are away from the imaginary straight line by an equal distance in the orthogonal direction.

Preferably, the second spring portion includes a second supporting arm portion that supports the connection portion, and extends from the connection portion in the intersecting direction, a second bent portion that is arc-shaped and is integrally connected to the second supporting arm portion, and a second intermediate arm portion that is integrally connected to the second bent portion, and extends in a direction opposite to the second supporting arm portion, wherein the integral connection portion includes a third bent portion that is arc-shaped and is integrally connected to the first intermediate arm portion, a fourth bent portion that is arc-shaped and is integrally connected to the second intermediate arm portion, a fifth bent portion that is arc-shaped and integrally connects the third bent portion and the fourth bent portion, and wherein the first bent portion, the second bent portion, and the fifth bent portion are away from the imaginary straight line by an equal distance in the orthogonal direction.

Preferably, the second spring portion includes a second supporting arm portion that supports the connection portion, and extends from the connection portion in the intersecting direction, and a second intermediate arm portion that is integrally connected to the connection portion, and extends in a direction opposite to the second supporting arm portion, wherein the integral connection portion includes a second bent portion that is arc-shaped and is integrally connected to the second intermediate arm portion, a third bent portion that is arc-shaped and is integrally connected to the first intermediate arm portion, an integral connection portion-side arm portion that is integrally connected to the third bent portion, and extends along the connection direction, a fourth bent portion that is arc-shaped and is integrally connected to the integral connection portion-side arm portion, and a straight arm portion that integrally connects the second bent portion and the fourth bent portion, and wherein the first bent portion, the second bent portion, and the fourth bent portion are away from the imaginary straight line by an equal distance in the orthogonal direction.

Preferably, the second spring portion includes a second supporting arm portion that supports the connection portion, and extends from the connection portion along the connection direction, a second bent portion that is arc-shaped and is integrally connected to the second supporting arm portion, a second intermediate arm portion that is integrally connected to the second bent portion, and extends in a direction opposite to the second supporting arm portion, a third bent portion that is arc-shaped and is integrally connected to the second intermediate arm portion, and a third intermediate arm portion that is integrally connected to the third bent portion, and extends in the intersecting direction, wherein the integral connection portion includes a fourth bent portion that is arc-shaped and is integrally connected to the third intermediate arm portion, a fifth bent portion that is arc-shaped and is integrally connected to the first intermediate arm portion, an integral connection portion-side arm portion that is integrally connected to the fifth bent portion, and extends along the connection direction, a sixth bent portion that is arc-shaped and is integrally connected to the integral connection portion-side arm portion, and a straight arm portion that integrally connects the fourth bent portion and the sixth bent portion, and wherein the second bent portion and the sixth bent portion are away from the imaginary straight line by an equal distance in the orthogonal direction.

Preferably, a front end portion of the contact portion protrudes out of a guide hole formed in the housing, and the guide hole guides the contact portion in the connection direction.

More preferably, the contact portion has a hollow cylindrical shape, and the front end portion of the contact portion has a spherical shape.

More preferably, the contact portion has a shape bent into a U-shape, and the front end portion of the contact portion is a bottom portion of the U-shape.

More preferably, the contact portion is plate-shaped.

More preferably, the connection portion is brought into contact with the second object to be connected, and is thereby electrically connected thereto.

More preferably, the connection portion is soldered to the second object to be connected and is thereby electrically connected thereto.

More preferably, the contact accommodation space extends in a direction oblique to a longitudinal direction of the housing.

According to the present invention, it is possible to reduce the height of the connector without reducing contact reliability.

The above and other objects, features and advantages of the present invention will become more apparent from the following detailed description taken in conjunction with the accompanying drawings.

DETAILED DESCRIPTION OF THE PREFERRED EMBODIMENT

The present invention will now be described in detail with reference to the drawings showing preferred embodiments thereof.

Figure 1:
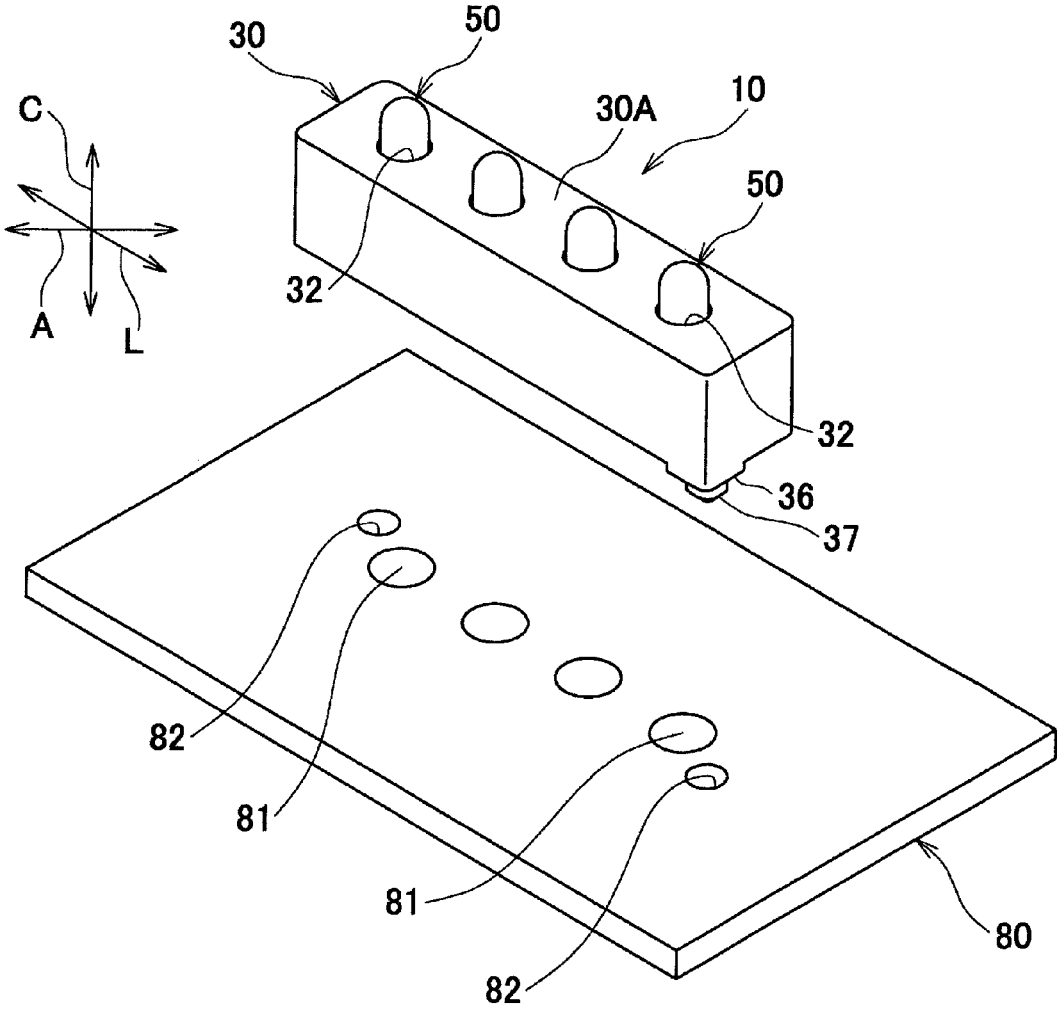
FIG. 1 is a perspective view of a connector according to a first embodiment of the present invention in a state before being connected to a printed circuit board.
Figure 6:
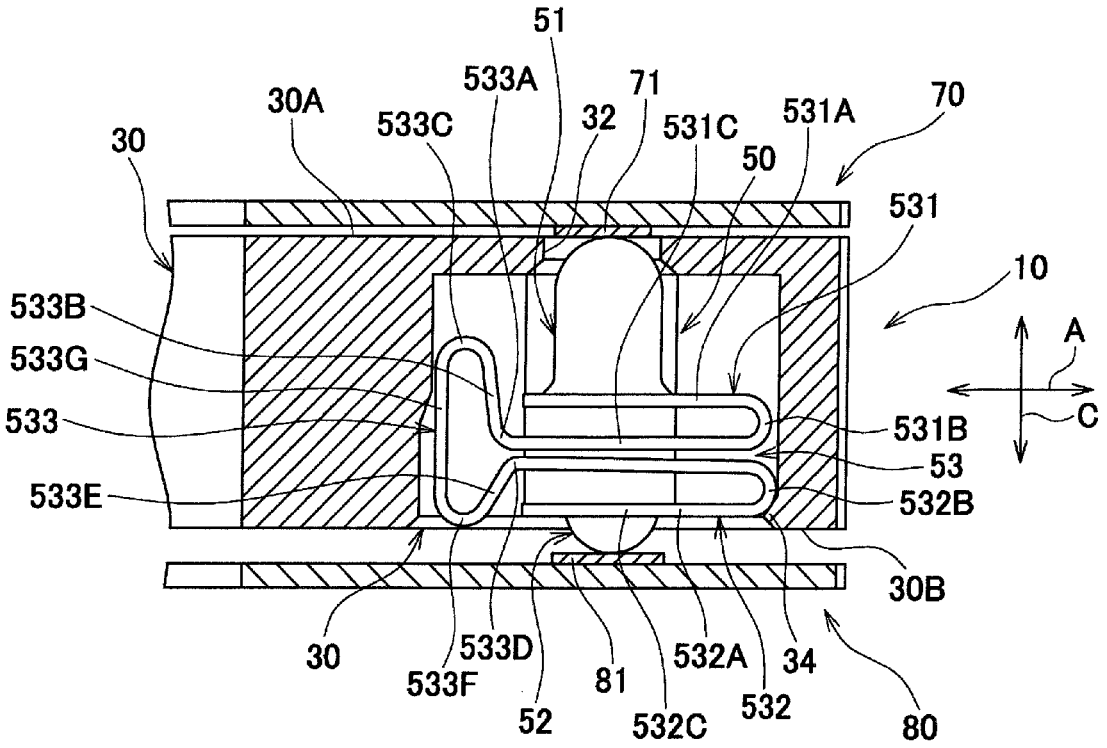
FIG. 6 is a cross-sectional view of the connector shown in FIG. 5 in a state sandwiched between a first printed circuit board and a second printed circuit board with a contact not shown in cross section.

As shown in FIG. 1, a connector 10 according to a first embodiment of the present invention comprises a housing 30 and contacts 50. As shown in FIG. 6, the connector 10 is sandwiched between a first printed circuit board (first object to be connected) 70 and a second printed circuit board (second object to be connected) 80 to thereby electrically connect the first printed circuit board 70 and the second printed circuit board 80. Note that a direction in which contact portions 51 of the contacts 50 are urged by the first printed circuit board 70, thereby being brought into contact with the first printed circuit board 70, is defined as a connection direction C.

Figure 2:
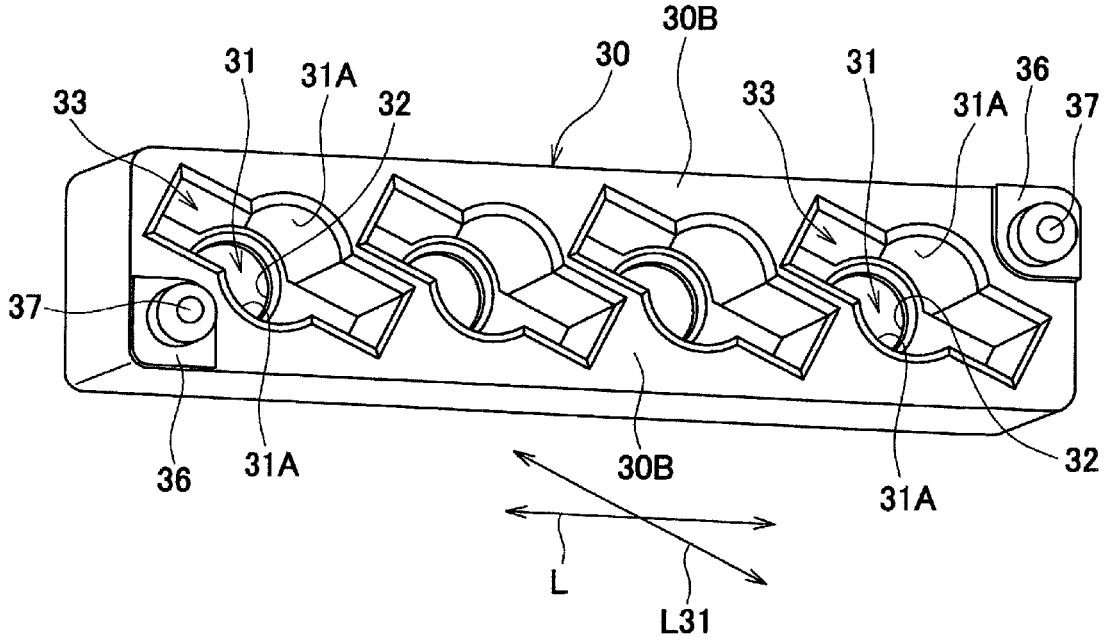
FIG. 2 is a perspective view of a housing of the connector shown in FIG. 1, as viewed obliquely from below.
Figure 4:
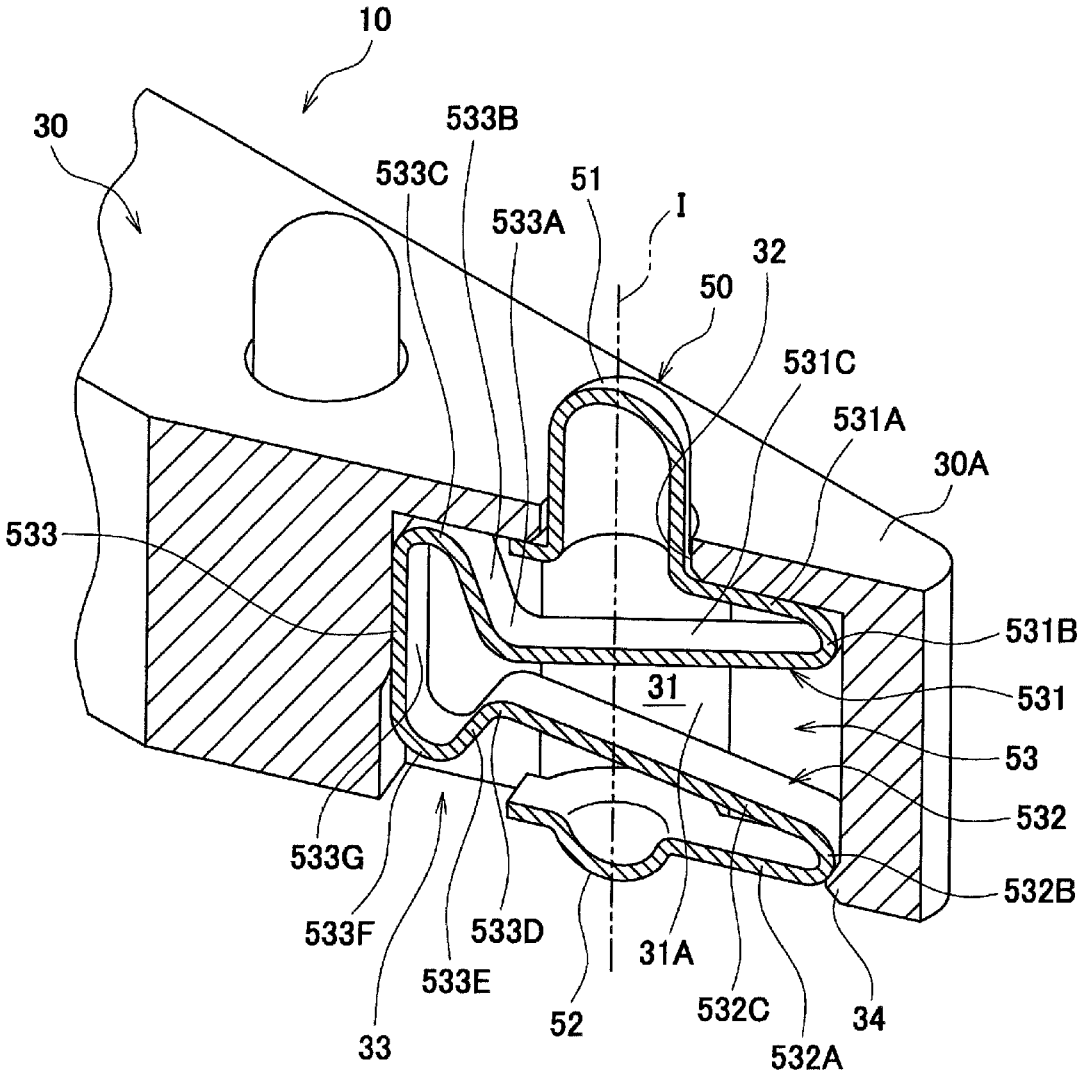
FIG. 4 is a fragmentary perspective view, partly in cross-section, of the connector shown in FIG. 1 in which one end of the connector is cut along a plane oblique to a longitudinal direction thereof and extending through a contact accommodation space.

As shown in FIGS. 1, 2, and 4, the housing 30 has a substantially rectangular parallelepiped shape. The housing 30 has a plurality of contact accommodation spaces 31 formed therein at equally-spaced intervals in a longitudinal direction L of the housing 30. The contact accommodation spaces 31 accommodate the contacts 50, respectively. A horizontal cross-section of each contact accommodation space 31 formed by cutting the housing 30 in a direction orthogonal to the connection direction C in which the first printed circuit board 70 is connected thereto has a substantially rectangular shape. A longitudinal direction L31 of the horizontal cross-section of each contact accommodation space 31 obliquely intersects with the longitudinal direction L of the housing 30 (see FIG. 2). The respective longitudinal directions L31 of the horizontal cross-sections of the plurality of contact accommodation spaces 31 are parallel to each other. Each contact accommodation space 31 reaches a lower surface 30B of the housing 30, forming an opening 33 therein.

An upper surface 30A of the housing 30 has a plurality of guide holes 32 formed therein at equally-spaced intervals in the longitudinal direction L of the housing 30. The guide holes 32 are circular holes, and communicate with the contact accommodation spaces 31, respectively.

Further, each contact accommodation space 31 has a pair of recesses 31A. The recesses 31A are formed to prevent the housing 30 from being brought into contact with a contact portion 51 and a connection portion 52, referred to hereinafter.

Further, the lower surface 30B of the housing 30 has leg parts 36 formed thereon at two corners on a diagonal line of the lower surface 30B. Each leg part 36 is formed with a positioning pin 37 extending in the connection direction C.

Further, the housing 30 is formed with stoppers 34 (see FIG. 4) on a lower part thereof. Each stopper 34 protrudes into the contact accommodation space 31.

Figure 3:
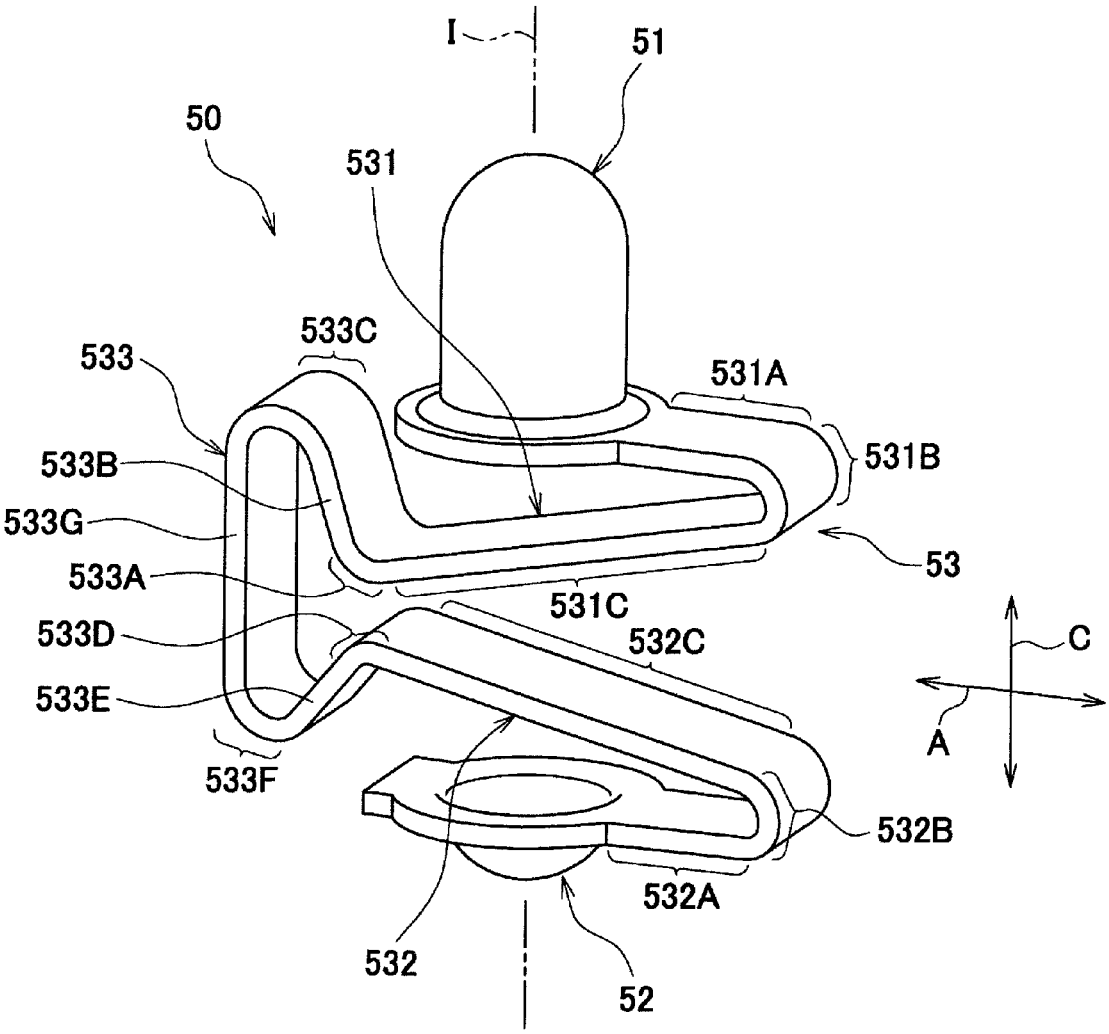
FIG. 3 is a perspective view of a contact of the connector shown in FIG. 1.

As shown in FIG. 3, each contact 50 includes the contact portion 51, the connection portion 52, and an elastically deforming portion 53. The contacts 50 are formed by blanking, bending, and drawing a metal plate (not shown), using presses.

As shown in FIG. 4, the contact portion 51 is mostly hollow cylindrical in shape, and has one end formed into a spherical shape. The contact portion 51 is inserted through an associated one of the guide holes 32, and protrudes out from the upper surface 30A of the housing 30. The contact portion 51 is guided by the associated guide hole 32 in the connection direction C. The contact portion 51 is brought into contact with a pad 71 of the first printed circuit board 70 when the connector 10 is sandwiched between the first printed circuit board 70 and the second printed circuit board 80 (see FIG. 6).

Figure 5:
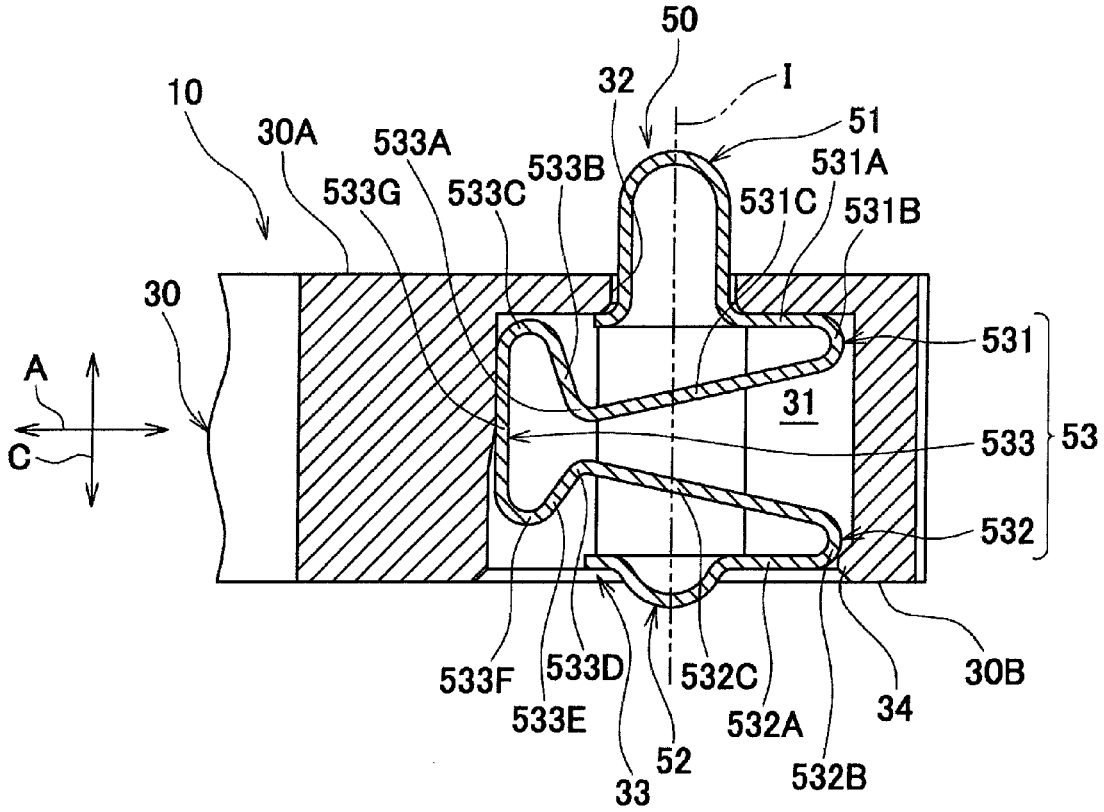
FIG. 5 is a cross-sectional view of the connector shown in FIG. 4, as viewed from a direction perpendicular to the cross-section of FIG. 4.

The connection portion 52 has a substantially hemispherical shape, and protrudes out from the lower surface 30B of the housing 30 through the opening 33 (see FIG. 5). The connection portion 52 is brought into contact with a pad 81 of the second printed circuit board 80 when the connector 10 is sandwiched between the first printed circuit board 70 and the second printed circuit board 80 (see FIG. 6).

The elastic deformation portion 53 integrally connects the contact portion 51 and the connection portion 52. The elastic deformation portion 53 is elastically deformed and compressed when the connector 10 is sandwiched between the first printed circuit board 70 and the second printed circuit board 80, as shown in FIG. 6.

As shown in FIGS. 3 to 5, the elastic deformation portion 53 is formed by a first spring portion 531 having a substantially J-shape, a second spring portion 532 having a substantially J-shape, and an integral connection portion 533 having a substantially C-shape.

The first spring portion 531 includes a first supporting arm portion 531A, a first bent portion 531B, and a first intermediate arm portion 531C. The first supporting arm portion 531A has one end integrally connected to the contact portion 51, and extends in an orthogonal direction A orthogonal to the connection direction C (in the same direction as the longitudinal direction L31 of the horizontal cross-section of the contact accommodation space 31). Note that the first supporting arm portion 531A may extend in an obliquely intersecting direction obliquely intersecting with the connection direction C (in an obliquely downward direction from the contact portion 51, as viewed in FIG. 5, not shown). The first bent portion 531B is an arc-shaped portion which is bent back from the other end of the first supporting arm portion 531A toward an imaginary straight line I (imaginary straight line extending through the contact portion 51, which is parallel to the connection direction C). The first intermediate arm portion 531C has one end integrally connected to the first bent portion 531B, and extends in a manner obliquely intersecting with the imaginary straight line I.

The second spring portion 532 includes a second supporting arm portion 532A, a second bent portion 532B, and a second intermediate arm portion 532C. The second supporting arm portion 532A has one end integrally connected to the connection portion 52, and extends in the orthogonal direction A. Note that the second supporting arm portion 532A may extend in an obliquely intersecting direction obliquely intersecting with the connection direction C (in an obliquely upward direction from the contact portion 52, as viewed in FIG. 5, not shown). The second bent portion 532B is an arc-shaped portion which is bent back from the other end of the second supporting arm portion 532A toward the imaginary straight line I. The second intermediate arm portion 532C has one end integrally connected to the second bent portion 532B, and extends in a manner obliquely intersecting with the imaginary straight line I. A distance between the first intermediate arm portion 531C and the second intermediate arm portion 532C in the connection direction C increases as a distance measurement point in the orthogonal direction A becomes farther from the integral connection portion 533. In other words, the first intermediate arm portion 531C and the second intermediate arm portion 532C extend in the respective obliquely intersecting directions such that the distance therebetween becomes larger as they extend farther from the integral connection portion 533.

The integral connection portion 533 includes a third bent portion 533A, a first integral connection portion-side arm portion 533B, a fourth bent portion 533C, a fifth bent portion 533D, a second integral connection portion-side arm portion 533E, a sixth bent portion 533F, and a straight arm portion 533G. The third bent portion 533A is an arc-shaped portion which is bent from the other end of the first intermediate arm portion 531C toward the contact portion 51. The first integral connection portion-side arm portion 533B has one end integrally connected to the third bent portion 533A, and extends in a direction slightly oblique to the connection direction C. The fourth bent portion 533C is an arc-shaped portion which is bent back from the other end of the first integral connection portion-side arm portion 533B toward the connection portion 52. The fifth bent portion 533D is an arc-shaped portion which is bent from the other end of the second intermediate arm portion 532C toward the connection portion 52. The second integral connection portion-side arm portion 533E has one end integrally connected to the fifth bent portion 533D and extends in a direction slightly oblique to the connection direction C. The sixth bent portion 533F is an arc-shaped portion which is bent back from the other end of the second integral connection portion-side arm portion 533E toward the contact portion 51. The straight arm portion 533G integrally connects the fourth bent portion 533C and the sixth bent portion 533F. The straight arm portion 533G extends in the connection direction C. Note that one or both of the first integral connection portion-side arm portion 533B and the second integral connection portion-side arm portion 533E may extend in a direction parallel to the connection direction C, similarly to the straight arm portion 533G.

The contact 50 in FIG. 3 is substantially rectangular in plan view (not shown), as viewed from above or below.

As shown in FIG. 3, although the contact portion 51, the first spring portion 531, the second spring portion 532, and the connection portion 52 are arranged on the imaginary straight line I, the integral connection portion 533 is away from the imaginary straight line I in the orthogonal direction A, and is not located on the imaginary straight line I.

The first bent portion 531B, the second bent portion 532B, the fourth bent portion 533C, and the sixth bent portion 533F are away from the imaginary straight line I by an equal distance in the orthogonal direction A ("equal distance" means "nearly equal distance", and does not mean "strictly equal distance", which applies similarly hereinafter).

To accommodate each contact 50 in an associated one of the contact accommodation spaces 31 of the housing 30, the contact 50 is inserted in the contact accommodation space 31 through the opening 33. In doing this, although the second bent portion 532B is caught by the stopper 34, by pressing the integral connection portion 533 into the contact accommodation space 31, the second intermediate arm portion 532C is bent, whereby the second bent portion 532B is slid over the stopper 34. As a result, the contact 50 is prevented from falling out of the contact accommodation space 31.

To connect the first printed circuit board 70 and the second printed circuit board 80 using the connector 10, first, as shown in FIG. 1, the connector 10 is mounted on the second printed circuit board 80. At this time, the positioning pins 37 of the housing 30 of the connector 10 are inserted in positioning holes 82 of the second printed circuit board 80, respectively.

Next, the first printed circuit board 70 is positioned above the connector 10, and then is moved down to a state shown in FIG. 6. When the contact portions 51 are pressed by the first printed circuit board 70, the elastic deformation portions 53 of the contacts 50 are compressed, the integral connection portions 533 are moved downward, and the contact portions 51 are retracted into the contact accommodation spaces 31. At this time, the returning forces of the elastic deformation portions 53 of the contacts 50 bring the contact portions 51 into strong contact with the pads 71 of the first printed circuit board 70, and the connection portions 52 into strong contact with the pads 81 of the second printed circuit board 80. As a result, the first printed circuit board 70 and the second printed circuit board 80 are electrically connected by the connector 10.

According to the present embodiment, since the integral connection portion 533 is away from the imaginary straight line I in the orthogonal direction A, and is not located between the first spring portion 531 and the second spring portion 532 on the imaginary straight line I, it is possible to reduce the height of the connector 10, compared with the above-described conventional connector.

Further, since the first bent portion 531B, the second bent portion 532B, the fourth bent portion 533C, and the sixth bent portion 533F are away from the imaginary straight line I by the equal distance in the orthogonal direction A, when the contact portion 51 is pressed down by the first printed circuit board 70, the contact portion 51 is hardly moved in the orthogonal direction A orthogonal to the connection direction C. Therefore, compared with a connector (not shown) having a structure in which the contact portion 51 moves in the orthogonal direction A, it is not necessary to increase the size of the pad 71 of the first printed circuit board 70 in the orthogonal direction A, and hence the connector according to the present embodiment can cope with electrical connection between the printed circuit boards each having pads arranged at a narrow pitch. This makes it possible to easily reduce the size of the connector 10.

Further, since the contact portions 51 are hardly moved in the orthogonal direction A, it is possible to form the guide holes 32 in the housing 30 which have a inner diameter slightly larger than the outer diameter of the contact portions 51. This makes it possible to prevent dust from entering the housing 30, and improve the appearance of the connector 10.

Further, the longitudinal direction of the planar shape of the contact 50 as viewed from above or below is oblique to the longitudinal direction L of the housing 30, and hence even if the elastic deformation portion 53 of each contact 50 is softened by increasing the length of the elastic deformation portion 53 with a view to improving the contact stability of the contact 50, it is possible to reduce the length of the housing 30 in the longitudinal direction L, as shown in FIG. 2, compared with a connector (not shown) having a structure in which the longitudinal direction of the planar shape of the contact 50 is parallel to the longitudinal direction L of the housing 30, which makes it possible to prevent the connector 10 from being increased in size. Further, it is also possible to reduce the width of the housing 30, which is orthogonal to the longitudinal direction L, compared with a connector (not shown) having a structure in which the longitudinal direction of the planar shape of the contact 50 is parallel to a direction orthogonal to the longitudinal direction L of the housing 30.

Next, a description will be given of a first variation of the first embodiment with reference to FIG. 7.

Figure 7:
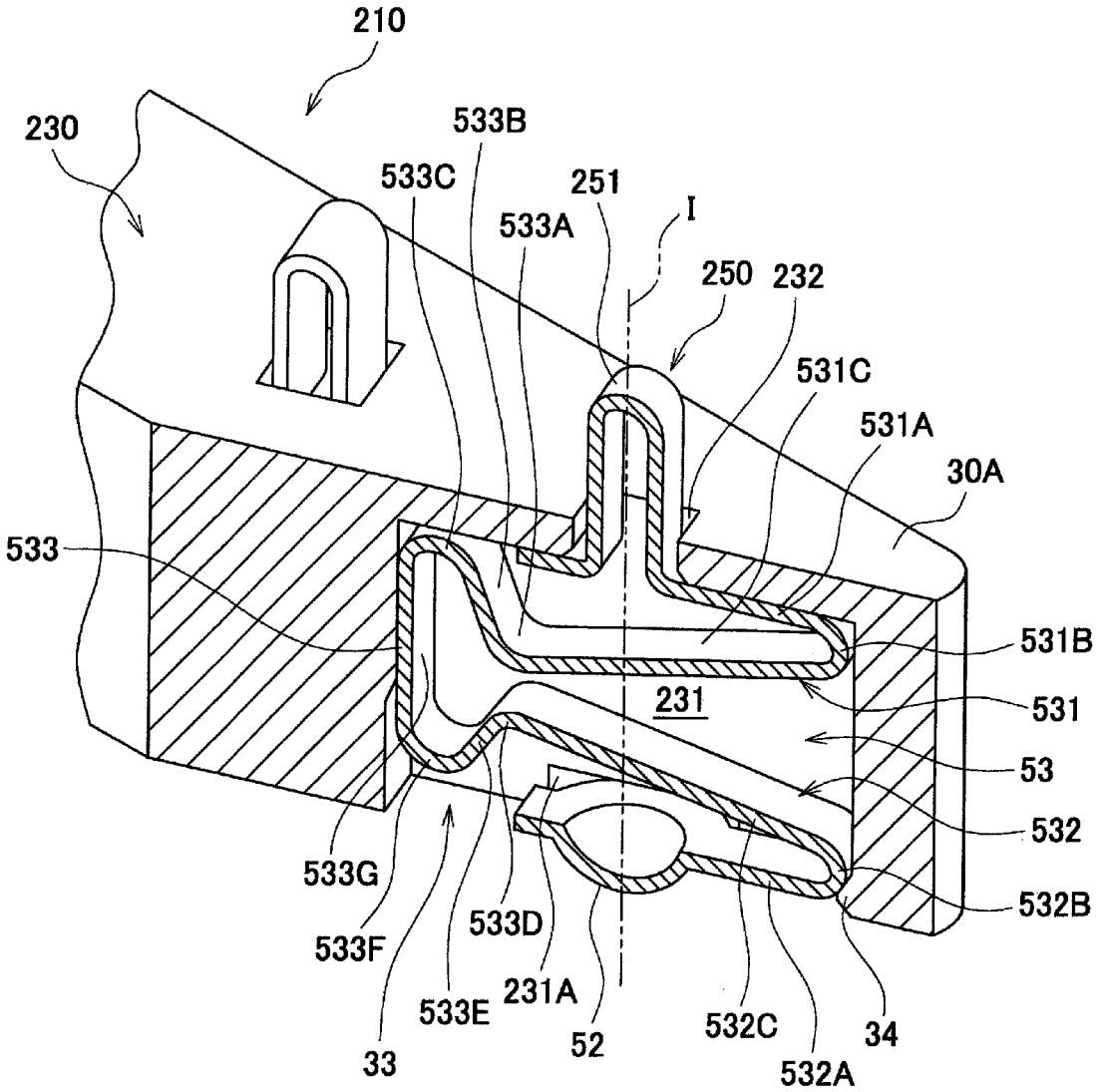
FIG. 7 is a fragmentary perspective view, partly in cross-section, of a first variation of the connector shown in FIG. 1.

As shown in FIG. 7, in a connector 210 as the first variation, a contact portion 251 of each contact 250 is formed by bending a metal plate into a U-shape, such that a bottom portion of the U-shape protrudes from a guide hole 232. Each guide hole 232 of a housing 230 is a rectangular hole. Further, the housing 230 is formed with recesses 231A in a lower part thereof, such that each recess 231A prevents the connection portion 52 from moving upward by being pressed and thereby being brought into contact with the second spring portion 532. Further, the recesses 231A make it possible to prevent, when accommodating the contacts 250 into contact accommodation spaces 231 of the housing 230, the contacts 250 from being unable to be accommodated in the contact accommodation spaces 231 due to the abutment of the connection portions 52 of the contacts 250 with the lower surface 30B of the housing 230.

According to the connector 210 as the first variation, it is possible to obtain the same advantageous effects as provided by the connector 10 of the first embodiment, and further, each contact portion 251 is simple in shape, which makes it easier to manufacture the contacts 250.

Next, a description will be given of a second variation of the first embodiment with reference to FIG. 8.

Figure 8:
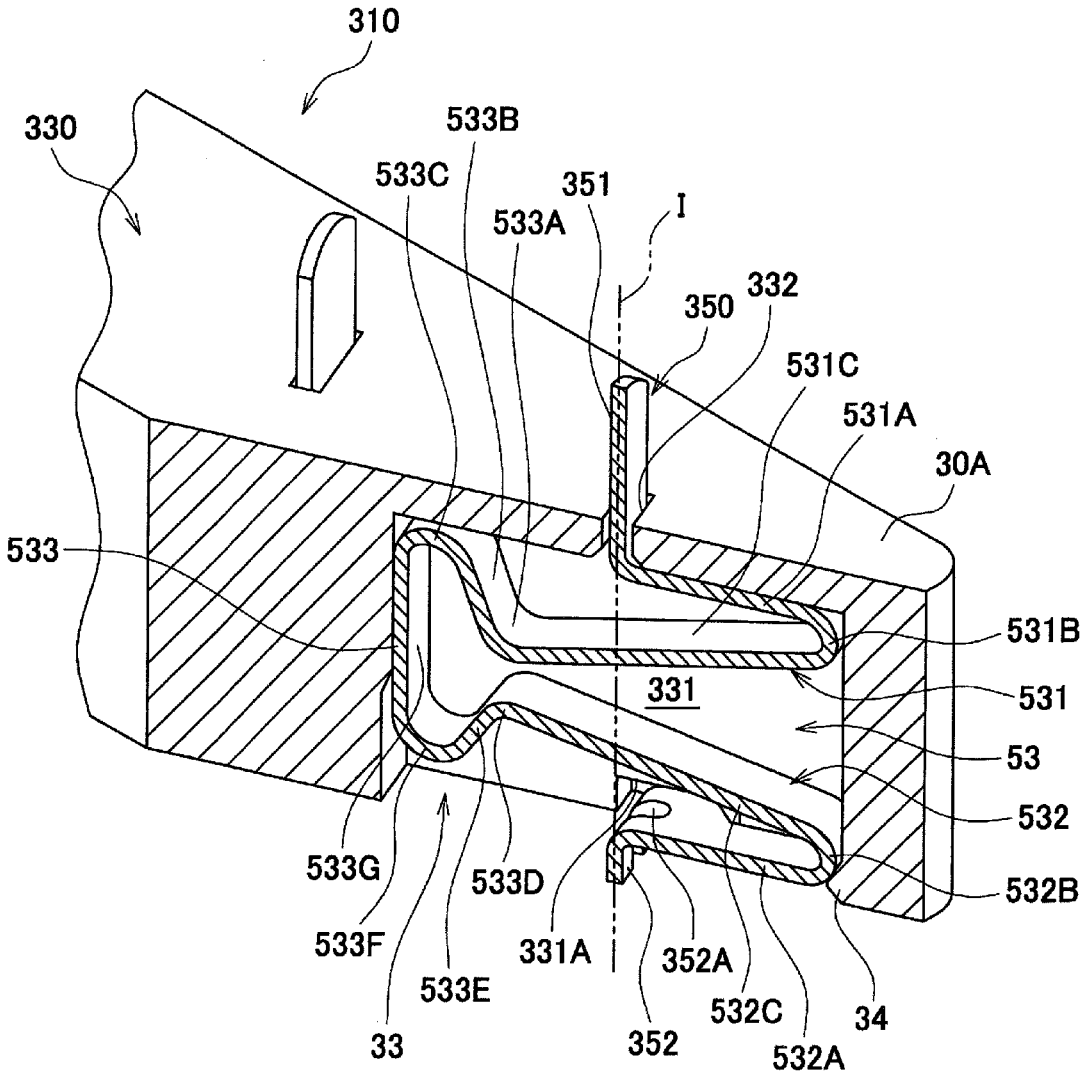
FIG. 8 is a fragmentary perspective view, partly in cross-section, of a second variation of the connector shown in FIG. 1.

As shown in FIG. 8, in a connector 310 as the second variation, each contact 350 has a contact portion 351 which is formed into a plate shape, and a connection portion 352 which is bent into a hook shape. A slit 352A is formed in the connection portion 352, whereby the connection portion 352 is bifurcated. Each guide hole 332 of a housing 330 is a rectangular hole. Further, the housing 330 is formed with recesses 331A in a lower part thereof such that each recess 331A prevents the connection portion 352 from moving upward by being pressed and thereby being brought into contact with the second spring portion 532. Further, the recesses 331A make it possible to prevent, when accommodating the contacts 350 into contact accommodation spaces 331 of the housing 330, the contacts 350 from being unable to be accommodated in the contact accommodation spaces 331 due to the abutment of the connection portions 352 of the contacts 350 with the lower surface 30B of the housing 330.

According to the connector 310 as the second variation, it is possible to obtain the same advantageous effects as provided by the connector 10 of the first embodiment, and further, each contact portion 351 and each connection portion 352 are simple in shape, which makes it easier to manufacture the contacts 350.

Next, a description will be given of a second embodiment of the present invention with reference to FIG. 9.

Figure 9:
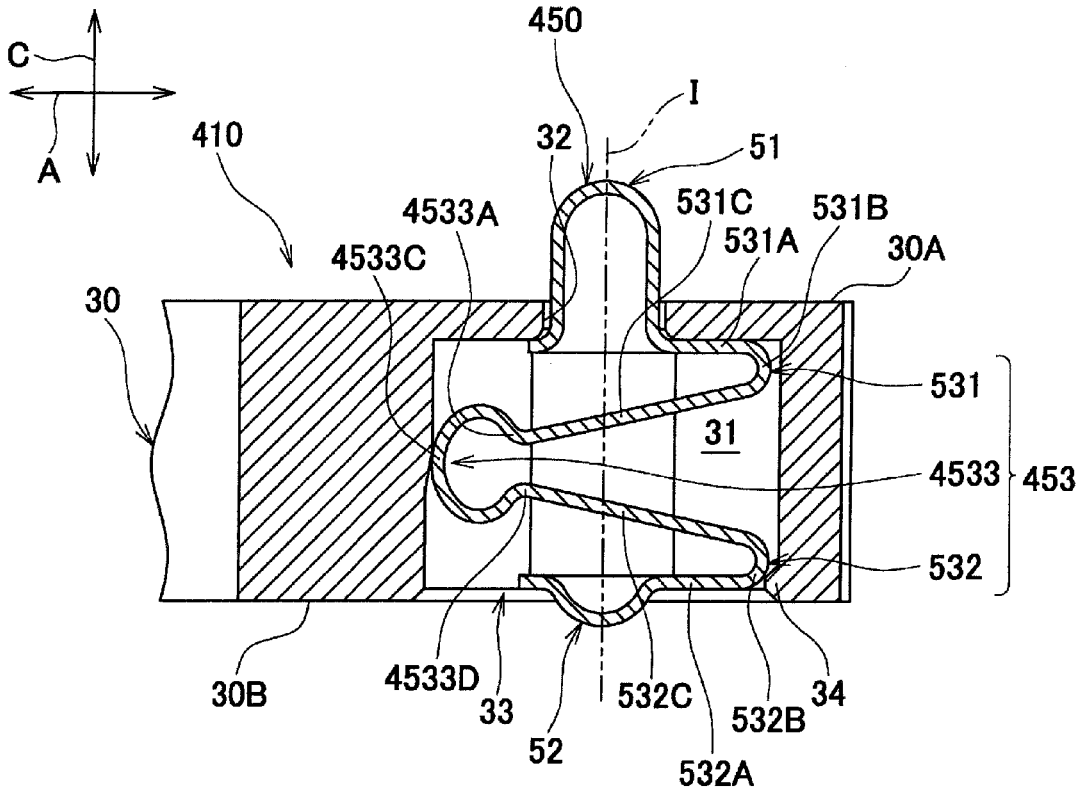
FIG. 9 is a cross-sectional view of a connector according to a second embodiment of the present invention.

As shown in FIG. 9, a connector 410 of the second embodiment differs from the connector 10 of the first embodiment in the construction of an integral connection portion 4533 of an elastic deformation portion 453 of each contact 450, as described hereafter.

The integral connection portion 4533 includes a third bent portion 4533A, a fourth bent portion 4533D, and a fifth bent portion 4533C. The third bent portion 4533A which is an arc-shaped is integrally connected to the other end of the first intermediate arm portion 531C. The fourth bent portion 4533D which is an arc-shaped is integrally connected to the other end of the second intermediate arm portion 532C. The fifth bent portion 4533C is C-shaped, and integrally connects the third bent portion 4533A and the fourth bent portion 4533D.

According to the connector 410 of the second embodiment, it is possible to obtain the same advantageous effects as provided by the connector 10 of the first embodiment.

Next, a description will be given of a third embodiment of the present invention with reference to FIG. 10.

Figure 10:
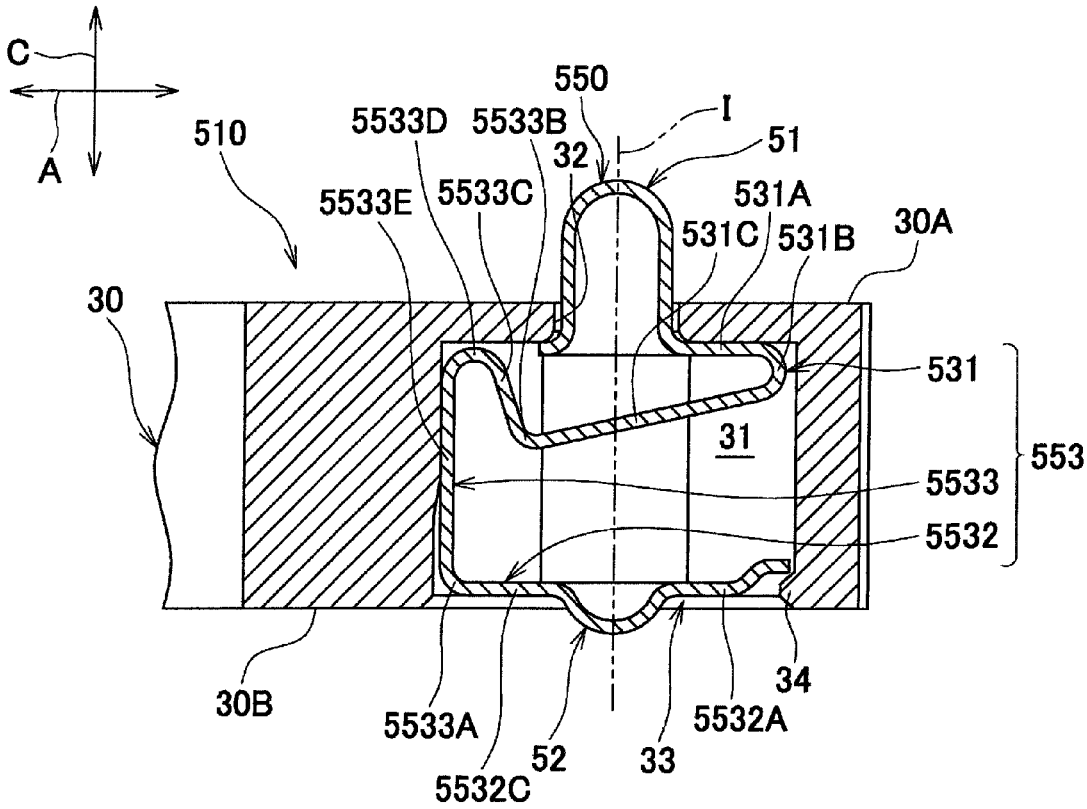
FIG. 10 is a cross-sectional view of a connector according to a third embodiment of the present invention.

As shown in FIG. 10, a connector 510 of the third embodiment differs from the connector 10 of the first embodiment in the construction of a second spring portion 5532 and an integral connection portion 5533 of an elastic deformation portion 553 of each contact 550.

The second spring portion 5532 includes a second supporting arm portion 5532A and a second intermediate arm portion 5532C. The second supporting arm portion 5532A supports the connection portion 52, and extends from one end of the connection portion 52 toward the stopper 34. The second supporting arm portion 5532A is formed into a crank shape, and is caught on the stopper 34. The second intermediate arm portion 5532C extends from the other end of the connection portion 52 to the integral connection portion 5533 in the orthogonal direction A. Note that the second intermediate arm portion 5532C may extend in an obliquely intersecting direction obliquely intersecting with the connection direction C (in an obliquely upward direction from the contact portion 52, as viewed in FIG. 10, not shown). The second intermediate arm portion 5532C is elastically deformable in the connection direction C.

The integral connection portion 5533 includes a second bent portion 5533A, a third bent portion 5533B, an integral connection portion-side arm portion 5533C, a fourth bent portion 5533D, and a straight arm portion 5533E. The third bent portion 5533B is an arc-shaped portion which is bent from the other end of the first intermediate arm portion 531C toward the contact portion 51. The integral connection portion-side arm portion 5533C has one end integrally connected to the third bent portion 5533B. The integral connection portion 5533 is accommodated in the contact accommodation space 31 in a manner movable in the connection direction C. The fourth bent portion 5533D is bent back from the other end of the integral connection portion-side arm portion 5533C toward the lower part of the housing 30. The straight arm portion 5533E has one end integrally connected to the second bent portion 5533A, and the other end integrally connected to the fourth bent portion 5533D. The straight arm portion 5533E is movable in the connection direction C.

In the case of the connector 510 of the third embodiment, when the connector 510 is sandwiched between the first printed circuit board 70 and the second printed circuit board 80, the integral connection portion 5533 is moved in the connection direction C in a smaller amount than in the case of the connectors of the other embodiments.

According to the connector 510 of the third embodiment, it is possible to obtain the same advantageous effects as provided by the connector 10 of the first embodiment, and further, each second spring portion 5532 is simple in construction, which makes it easier to manufacture the contacts 550.

Next, a description will be given of a fourth embodiment of the present invention with reference to FIG. 11.

Figure 11:
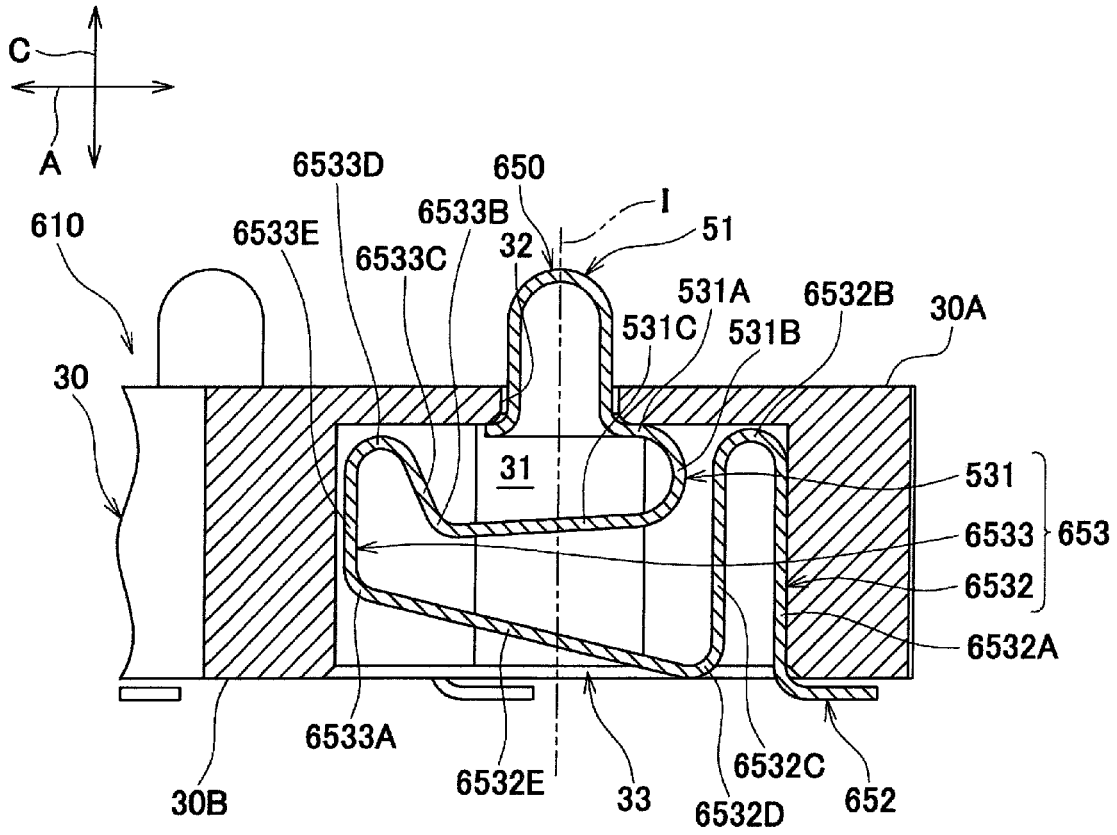
FIG. 11 is a cross-sectional view of a connector according to a fourth embodiment of the present invention.

As shown in FIG. 11, a connector 610 of the fourth embodiment differs from the connector 10 of the first embodiment in the construction of a connection portion 652, a second spring portion 6532 and an integral connection portion 6533 of an elastic deformation portion 653 of each contact 650.

The connection portion 652 is plate-shaped, and is soldered to the pad 81 of the second printed circuit board 80. The connection portion 652 protrudes out of the opening 33, and is opposed to the lower surface 30B of the housing 30.

The second spring portion 6532 includes a second supporting arm portion 6532A, a second bent portion 6532B, a second intermediate arm portion 6532C, a third bent portion 6532D, and a third intermediate arm portion 6532E. The second supporting arm portion 6532A has one end integrally connected to the connection portion 652, and extends in the connection direction C. The second supporting arm portion 6532A is fixed to the housing 30. The second bent portion 6532B is bent back from the other end of the second supporting arm portion 6532A toward the lower surface 30B of the housing 30. The second intermediate arm portion 6532C has one end integrally connected to the second bent portion 6532B, and extends in the connection direction C. The third bent portion 6532D is bent back from the other end of the second intermediate arm portion 6532C toward the contact portion 51. The third intermediate arm portion 6532E has one end integrally connected to the third bent portion 6532D, and extends in a manner obliquely intersecting with the imaginary straight line I. The other end of the third intermediate arm portion 6532E is farther away from the lower surface 30B in the connection direction C than the third bent portion 6532D is.

The integral connection portion 6533 includes a fourth bent portion 6533A, a fifth bent portion 6533B, an integral connection portion-side arm portion 6533C, a sixth bent portion 6533D, and a straight arm portion 6533E. The fourth bent portion 6533A is bent from the other end of the third intermediate arm portion 6532E toward the contact portion 51. The fifth bent portion 6533B is bent from the other end of the first intermediate arm portion 531C toward the contact portion 51. The integral connection portion-side arm portion 6533C has one end integrally connected to the fifth bent portion 6533B, and extends in a direction oblique to the connection direction C. Note that the integral connection portion-side arm portion 6533C may extend in a direction parallel to the connection direction C. The other end of the integral connection portion-side arm portion 6533C is farther away from the imaginary straight line I than the fifth bent portion 6533B is. The sixth bent portion 6533D is bent back from the other end of the integral connection portion-side arm portion 6533C toward the lower surface 30B. The straight arm portion 6533E has one end integrally connected to the fourth bent portion 6533A, and the other end integrally connected to the sixth bent portion 6533D.

The second bent portion 6532B and the sixth bent portion 6533D are away from the imaginary straight line I by an equal distance in the orthogonal direction A, respectively.

According to the connector 610 of the fourth embodiment, it is possible to obtain the same advantageous effects as provided by the connector 10 of the first embodiment.

Figure 12:
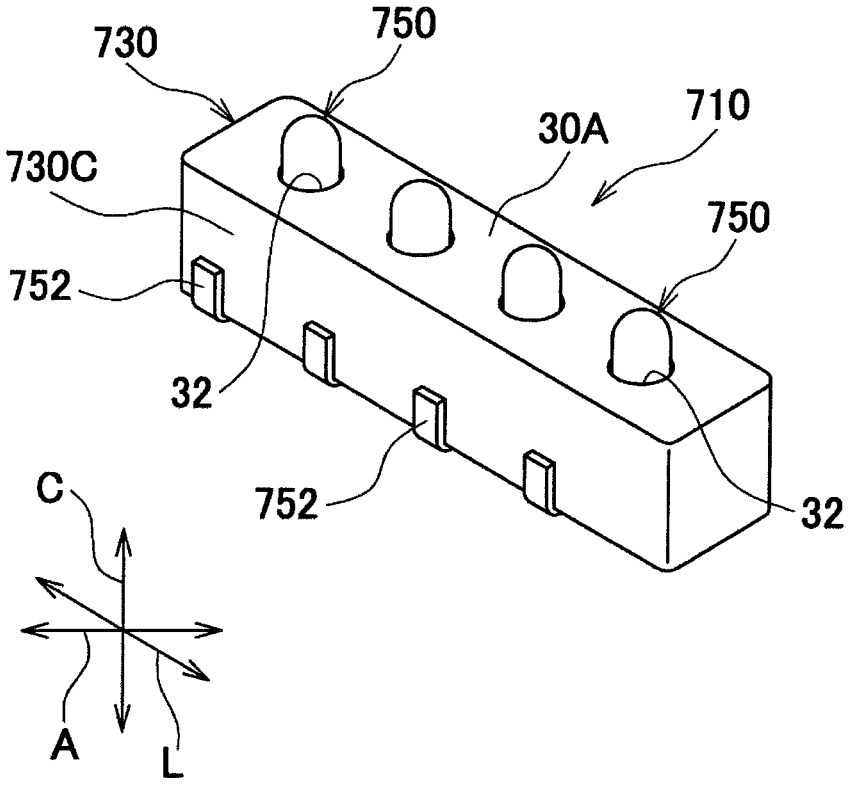
FIG. 12 is a perspective view of a variation of the connector according to the fourth embodiment, shown in FIG. 11.
Figure 13:
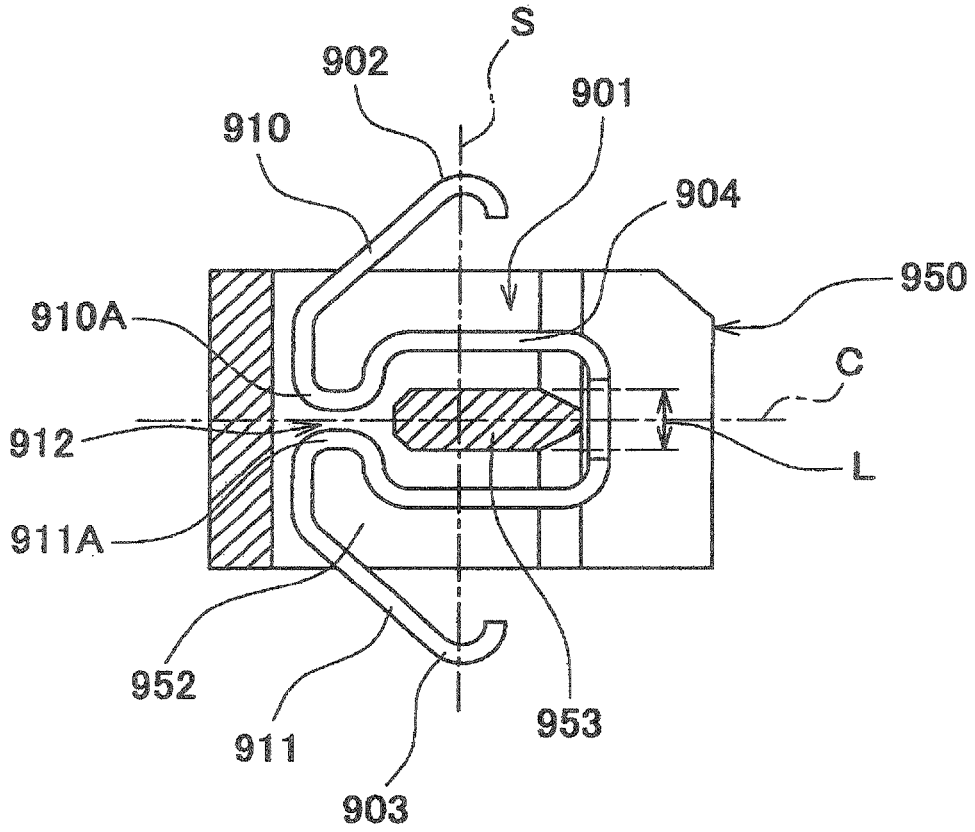
FIG. 13 Prior Art
FIG. 13 is a cross-sectional view of a conventional connector.
Figure 14:
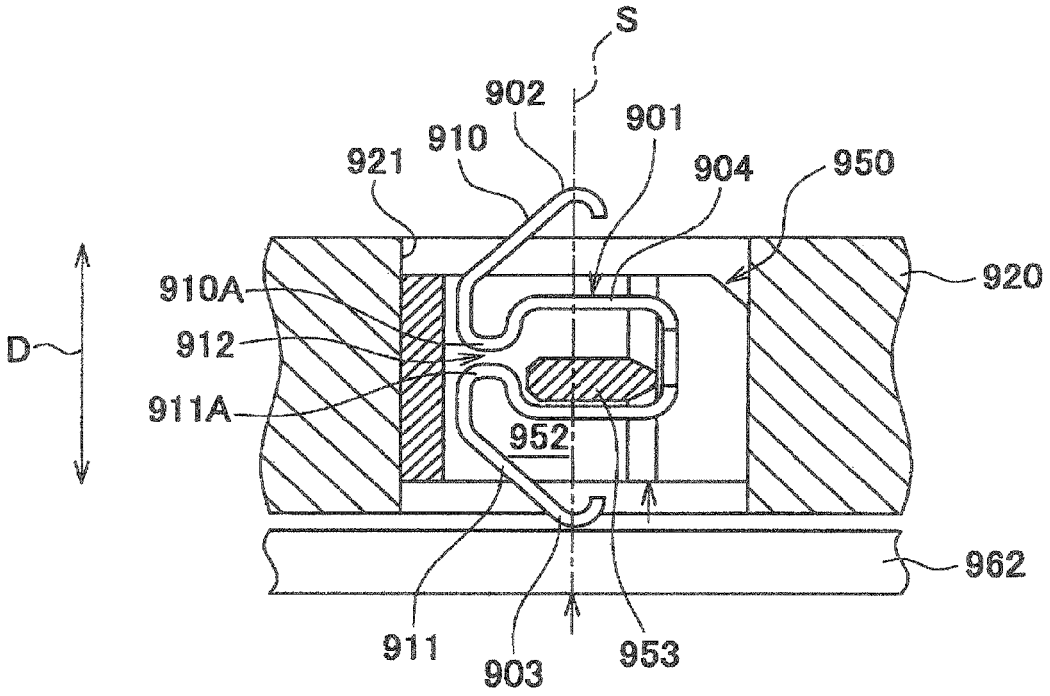
FIG. 14 Prior Art
FIG. 14 is a cross-sectional view of the connector shown in FIG. 13 in a state in which the connector is arranged on a lower printed circuit board, which is useful in explaining how the connector is used.
Figure 15:
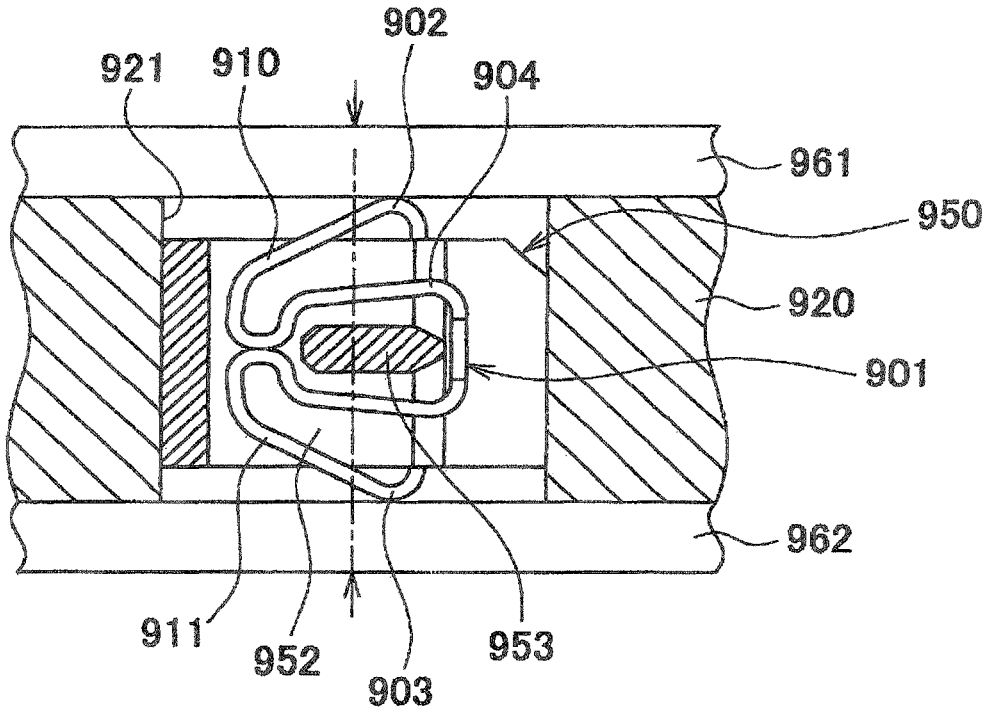
FIG. 15 Prior Art
FIG. 15 is a cross-sectional view of the connector shown in FIG. 13 in a state in which an upper printed circuit board and the lower printed circuit board are connected by the connector, which is useful in explaining how the connector is used.

FIG. 12 shows a connector as a variation of the fourth embodiment in which a connection portion 752 of each contact 750 is extended from the lower surface 30B of a housing 730 (see FIG. 11) to a side surface 730C. The contact 750 has the same construction as that of the contact 650 of the fourth embodiment except the connection portion 752, and the housing 730 has the same construction as that of the housing 30 except that the leg parts 36 and the positioning pins 37 are eliminated.

The connector 610 of the fourth embodiment is used for electrically connecting the first printed circuit board 70 and the second printed circuit board 80, which are opposed to each other. On the other hand, the connector of this variation, denoted by reference numeral 710, makes it possible to mount the connection portions 752 of the connector 710 on the pads 81 of the second printed circuit board 80 by soldering, in a state in which the side surface 730C of the housing 730 and the mounting surface of the first printed circuit board 80 are opposed to each other. Therefore, according to the connector 710 as this variation, it is possible to electrically connect the first printed circuit board 70 and the second printed circuit board 80 in a state in which the mounting surface of the first printed circuit board 70 is arranged at right angles to the mounting surface of the second printed circuit board 80.

Note that in the above-described embodiments except the fourth embodiment, although the connection portions 52 and 352 are formed as the contact portions which are brought into contact with and are thereby electrically connected to the pads 81 of the second printed circuit board 80, the connection portions 52 and 352 may be formed as soldering portions for being soldered to the pads 81 of the second printed circuit board 80. Further, although in the above-described embodiments, the contact portions 51, 251, and 351 are guided by the guide holes 32, 232, and 332 in the connection direction C, respectively, it is not necessarily required to provide a guiding function to the guide holes 32, 232, and 332.

Although in the above-described embodiments, the contact portions 51, 251, and 351 are formed such that they protrude from the upper surface 30A of the housings 30, 230, and 330 through the guide holes 32, 232, and 332, respectively, openings (not shown) may be formed in the upper surface 30A similarly to the openings 33 in the lower surface 30B of the housing 30.

It is further understood by those skilled in the art that the foregoing are the preferred embodiments of the present invention, and that various changes and modification may be made thereto without departing from the spirit and scope thereof.

What is claimed is:

1. A connector that includes a housing having contact accommodation spaces, and contacts accommodated in the contact accommodation spaces, respectively, said connector being adapted to electrically connect a first object to be connected and a second object to be connected, wherein:

each contact has a contact portion that is brought into contact with the first object to be connected, a connection portion that is brought into contact with the second object to be connected, and an elastic deformation portion that integrally connects the contact portion and the connection portion;

the elastic deformation portion comprises:

a first spring portion that is integrally connected to the contact portion;

a second spring portion that is integrally connected to the connection portion; and an integral connection portion that integrally connects the first spring portion and the second spring portion;

a direction in which, when connecting the first object to be connected and the second object to be connected, the contact portion is urged by the first object to be connected and is brought into contact with the first object to be connected, is defined as a connection direction;

the first spring portion includes:

a first supporting arm portion that supports the contact portion, and extends from the contact portion in an intersecting direction intersecting with the connection direction;

a first bent portion that is arc-shaped and is integrally connected to the first supporting arm portion; and a first intermediate arm portion that is integrally connected to the first bent portion, and extends in a direction opposite to the first supporting arm portion;

the first spring portion and the second spring portion are arranged on an imaginary straight line parallel to the connection direction, the imaginary straight line extending through the contact portion;

the integral connection portion is displaced from the imaginary straight line in an orthogonal direction which is orthogonal to the connection direction;

the second spring portion includes:

a second supporting arm portion that supports the connection portion, and extends from the connection portion in the intersecting direction;

a second bent portion that is arc-shaped and is integrally connected to the second supporting arm portion; and a second intermediate arm portion that is integrally connected to the second bent portion, and extends in a direction opposite to the second supporting arm portion;

the integral connection portion includes:

a third bent portion that is arc-shaped and is integrally connected to the first intermediate arm portion;

a first integral connection portion-side arm portion that is integrally connected to the third bent portion, and extends along the connection direction;

a fourth bent portion that is arc-shaped and is integrally connected to the first integral connection portion-side arm portion;

a fifth bent portion that is arc-shaped and is integrally connected to the second intermediate arm portion;

a second integral connection portion-side arm portion that is integrally connected to the fifth bent portion, and extends in a direction opposite to the first integral connection portion-side arm portion;

a sixth bent portion that is arc-shaped and is integrally connected to the second integral connection portion-side arm portion; and a straight arm portion that integrally connects the fourth bent portion and the sixth bent portion; and the first bent portion, the second bent portion, the fourth bent portion, and the sixth bent portion are positioned away from the imaginary straight line by an equal distance in the orthogonal direction.

2. The connector according to claim 1, wherein the connection portion is brought into contact with the second object to be connected, and is thereby electrically connected thereto.

3. The connector according to claim 1, wherein the connection portion is soldered to the second object to be connected and is thereby electrically connected thereto.

4. The connector according to claim 1, wherein the contact accommodation space extends in a direction oblique to a longitudinal direction of the housing.

5. The connector according to claim 1, wherein when connecting the first object to be connected and the second object to be connected, the integral connection portion is movable in the connection direction.

6. The connector according to claim 5, wherein the connection portion is brought into contact with the second object to be connected, and is thereby electrically connected thereto.

7. The connector according to claim 5, wherein the connection portion is soldered to the second object to be connected and is thereby electrically connected thereto.

8. The connector according to claim 2, wherein the contact accommodation space extends in a direction oblique to a longitudinal direction of the housing.

9. The connector according to claim 1, wherein a front end portion of the contact portion protrudes out of a guide hole formed in the housing, and the guide hole guides the contact portion in the connection direction.

10. The connector according to claim 9, wherein the contact portion has a hollow cylindrical shape, and the front end portion of the contact portion has a spherical shape.

11. The connector according to claim 9, wherein the contact portion has a shape bent into a U-shape, and the front end portion of the contact portion is a bottom portion of the U-shape.

12. The connector according to claim 9, wherein the contact portion is plate-shaped.

13. The connector according to claim 5, wherein a front end portion of the contact portion protrudes out of a guide hole formed in the housing, and the guide hole guides the contact portion in the connection direction.

14. The connector according to claim 13, wherein the contact portion has a hollow cylindrical shape, and the front end portion of the contact portion has a spherical shape.

15. The connector according to claim 13, wherein the contact portion has a shape bent into a U-shape, and the front end portion of the contact portion is a bottom portion of the U-shape.

16. The connector according to claim 13, wherein the contact portion is plate-shaped.

17. A connector that includes a housing having contact accommodation spaces, and contacts accommodated in the contact accommodation spaces, respectively, said connector being adapted to electrically connect a first object to be connected and a second object to be connected, wherein:

each contact has a contact portion that is brought into contact with the first object to be connected, a connection portion that is brought into contact with the second object to be connected, and an elastic deformation portion that integrally connects the contact portion and the connection portion;

the elastic deformation portion comprises:

a first spring portion that is integrally connected to the contact portion;

a second spring portion that is integrally connected to the connection portion; and an integral connection portion that integrally connects the first spring portion and the second spring portion;

a direction in which, when connecting the first object to be connected and the second object to be connected, the contact portion is urged by the first object to be connected and is brought into contact with the first object to be connected, is defined as a connection direction;

the first spring portion includes:

a first supporting arm portion that supports the contact portion, and extends from the contact portion in an intersecting direction intersecting with the connection direction;

a first bent portion that is arc-shaped and is integrally connected to the first supporting arm portion; and a first intermediate arm portion that is integrally connected to the first bent portion, and extends in a direction opposite to the first supporting arm portion;

the first spring portion and the second spring portion are arranged on an imaginary straight line parallel to the connection direction, the imaginary straight line extending through the contact portion;

the integral connection portion is displaced from the imaginary straight line in an orthogonal direction which is orthogonal to the connection direction;

the second spring portion includes:

a second supporting arm portion that supports the connection portion, and extends from the connection portion in the intersecting direction; and a second intermediate arm portion that is integrally connected to the connection portion, and extends in a direction opposite to the second supporting arm portion;

the integral connection portion includes:

a second bent portion that is arc-shaped and is integrally connected to the second intermediate arm portion;

a third bent portion that is arc-shaped and is integrally connected to the first intermediate arm portion;

an integral connection portion-side arm portion that is integrally connected to the third bent portion, and extends along the connection direction;

a fourth bent portion that is arc-shaped and is integrally connected to the integral connection portion-side arm portion; and a straight arm portion that integrally connects the second bent portion and the fourth bent portion; and the first bent portion, the second bent portion, and the fourth bent portion are positioned away from the imaginary straight line by an equal distance in the orthogonal direction.

18. The connector according to claim 17, wherein when connecting the first object to be connected and the second object to be connected, the integral connection portion is movable in the connection direction.

19. A connector that includes a housing having contact accommodation spaces, and contacts accommodated in the contact accommodation spaces, respectively, said connector being adapted to electrically connect a first object to be connected and a second object to be connected, wherein:

each contact has a contact portion that is brought into contact with the first object to be connected, a connection portion that is brought into contact with the second object to be connected, and an elastic deformation portion that integrally connects the contact portion and the connection portion;

the elastic deformation portion comprises:

a first spring portion that is integrally connected to the contact portion;

a second spring portion that is integrally connected to the connection portion; and an integral connection portion that integrally connects the first spring portion and the second spring portion;

a direction in which, when connecting the first object to be connected and the second object to be connected, the contact portion is urged by the first object to be connected and is brought into contact with the first object to be connected, is defined as a connection direction;

the first spring portion includes:

a first supporting arm portion that supports the contact portion, and extends from the contact portion in an intersecting direction intersecting with the connection direction;

a first bent portion that is arc-shaped and is integrally connected to the first supporting arm portion; and a first intermediate arm portion that is integrally connected to the first bent portion, and extends in a direction opposite to the first supporting arm portion;

the first spring portion and the second spring portion are arranged on an imaginary straight line parallel to the connection direction, the imaginary straight line extending through the contact portion;

the integral connection portion is displaced from the imaginary straight line in an orthogonal direction which is orthogonal to the connection direction;

the second spring portion includes:

a second supporting arm portion that supports the connection portion, and extends from the connection portion along the connection direction;

a second bent portion that is arc-shaped and is integrally connected to the second supporting arm portion;

a second intermediate arm portion that is integrally connected to the second bent portion, and extends in a direction opposite to the second supporting arm portion;

a third bent portion that is arc-shaped and is integrally connected to the second intermediate arm portion; and a third intermediate arm portion that is integrally connected to the third bent portion, and extends in the intersecting direction;

the integral connection portion includes:

a fourth bent portion that is arc-shaped and is integrally connected to the third intermediate arm portion;

a fifth bent portion that is arc-shaped and is integrally connected to the first intermediate arm portion;

an integral connection portion-side arm portion that is integrally connected to the fifth bent portion, and extends along the connection direction;

a sixth bent portion that is arc-shaped and is integrally connected to the integral connection portion-side arm portion; and a straight arm portion that integrally connects the fourth bent portion and the sixth bent portion; and the second bent portion and the sixth bent portion are positioned away from the imaginary straight line by an equal distance in the orthogonal direction.

20. The connector according to claim 19, wherein when connecting the first object to be connected and the second object to be connected, the integral connection portion is movable in the connection direction.

* * * * *

UNITED STATES PATENT AND TRADEMARK OFFICE

CERTIFICATE OF CORRECTION

PATENT NO. : 9,281,584 B2
APPLICATION NO. : 14/487934
DATED : March 8, 2016
INVENTOR(S) : Osamu Hashiguchi It is certified that error appears in the above-identified patent and that said Letters Patent is hereby corrected as shown below:

In the Claims

Column 14, line 14, change “claim 2,” to --claim 5,--.

Signed and Sealed this
Nineteenth Day of July, 2016

Michelle K. Lee

Michelle K. Lee
*Director of the United States Patent and Trademark Office*